US011493043B2

(12) United States Patent
Verrelst

(10) Patent No.: US 11,493,043 B2
(45) Date of Patent: Nov. 8, 2022

(54) POSITIVE DISPLACEMENT MACHINE WITH KINEMATIC SYNCHRONIZATION COUPLING AND WITH DRIVEN MOVING PARTS HAVING THEIR OWN INDIVIDUAL DRIVES

(71) Applicant: ATLAS COPCO AIRPOWER, NAAMLOZE VENNOOTSCHAP, Wilrijk (BE)

(72) Inventor: Bjorn Verrelst, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 17/297,109

(22) PCT Filed: Dec. 17, 2019

(86) PCT No.: PCT/IB2019/060919

§ 371 (c)(1),
(2) Date: May 26, 2021

(87) PCT Pub. No.: WO2020/128830

PCT Pub. Date: Jun. 25, 2020

(65) Prior Publication Data

US 2021/0396229 A1 Dec. 23, 2021

(30) Foreign Application Priority Data

Dec. 18, 2018 (BE) ..... 2018/5894
Dec. 18, 2018 (BE) ..... 2018/5896
Dec. 17, 2019 (BE) ..... 2019/5922

(51) Int. Cl.
*F04C 18/16* (2006.01)
*F04C 2/16* (2006.01)
(Continued)

(52) U.S. Cl.
CPC ..... *F04C 18/16* (2013.01); *F04C 2/16* (2013.01); *F04C 15/008* (2013.01); *F04C 18/12* (2013.01);
(Continued)

(58) Field of Classification Search
CPC ..... F04C 2/12–20; F04C 18/12–20; F04C 2240/402; F04C 15/0061; F04C 15/008; F04C 28/08; F04C 29/005; F04C 29/0085
See application file for complete search history.

(56) References Cited

U.S. PATENT DOCUMENTS 5,674,063 A * 10/1997 Ozaki ..... F04C 23/005 418/201.3
5,767,635 A * 6/1998 Steffens ..... F04C 28/08 318/625

FOREIGN PATENT DOCUMENTS

BE 2015/5250 A1 10/2016
CN 110360109 A * 10/2019 ..... F04C 18/18
(Continued)

OTHER PUBLICATIONS

International Search Report and Written Opinion in corresponding PCT Application No. PCT/IB2019/060919, dated Mar. 2, 2020.
(Continued)

*Primary Examiner* — Laert Dounis
(74) *Attorney, Agent, or Firm* — Bacon & Thomas, PLLC

(57) ABSTRACT

Positive displacement machine such as a compressor, expander, pump or the like, for displacing a gaseous or liquid medium, the machine containing an element with at least one inlet and at least one outlet for the medium and at least two cooperating driven moving parts. The mutual periodic movement of the moving parts displaces the medium from the inlet to the outlet. Each of the at least two driven cooperating moving parts is provided with its own individual drive. The element is provided with a kinematic
(Continued)

synchronisation coupling between the at least two cooperating moving parts for the mutual kinematic synchronisation of their movements.

15 Claims, 2 Drawing Sheets

(51) Int. Cl.

| | |
|---|---|
| ***F04C 27/00*** | (2006.01) |
| ***F04C 29/04*** | (2006.01) |
| ***F04C 28/08*** | (2006.01) |
| ***F04C 29/00*** | (2006.01) |
| ***F04C 15/00*** | (2006.01) |
| ***F04C 18/12*** | (2006.01) |

(52) U.S. Cl.
CPC ..... *F04C 27/009* (2013.01); *F04C 28/08* (2013.01); *F04C 29/005* (2013.01); *F04C 29/0085* (2013.01); *F04C 29/04* (2013.01); *F04C 2240/402* (2013.01)

(56) References Cited

FOREIGN PATENT DOCUMENTS

| | | | | |
|---|---|---|---|---|
| EP | 0816683 | A1 | | 1/1998 |
| EP | 1059454 | A1 | | 12/2000 |
| JP | 60259791 | A | * | 12/1985 |
| JP | S62195481 | A | | 8/1987 |
| JP | H08338382 | A | | 12/1996 |
| JP | 2008261225 | A | * | 10/2008 |
| JP | 2010209746 | A | | 9/2010 |
| JP | 2015220905 | A | | 12/2015 |
| WO | 2018093440 | A1 | | 5/2018 |

OTHER PUBLICATIONS

International Preliminary Report on Patentability in corresponding PCT Application No. PCT/IB2019/060919, dated Dec. 23, 2020.
Second Written Opinion in corresponding PCT Application No. PCT/IB2019/060919, dated Oct. 26, 2020.

* cited by examiner

POSITIVE DISPLACEMENT MACHINE WITH KINEMATIC SYNCHRONIZATION COUPLING AND WITH DRIVEN MOVING PARTS HAVING THEIR OWN INDIVIDUAL DRIVES

The present invention relates to a positive displacement machine such as a compressor, expander, pump or the like, for displacing a gaseous or liquid medium.

BACKGROUND OF THE INVENTION

Such positive displacement machines which contain an element with an inlet and an outlet for the medium and with at least two cooperating driven moving parts are already known, whereby the mutual movement of the moving parts displaces the medium from the inlet to the outlet, whereby the element is provided with a kinematic coupling between the at least two cooperating parts for the mutual synchronisation of the movements of these parts.

An example of such positive displacement machine is a screw compressor or a screw expander whereby the aforementioned element is provided with two helical cooperating rotors which partly engage their screws in each other to compress or expand gas between the screws by their mutual movement.

Such element of a screw compressor or screw expander is always provided with one single drive in the form of a rotative motor which drives one of both helical rotors through the agency of a robust gear transmission.

The other rotor is then driven via the first rotor and through the agency of a torque transfer transmission between both rotors in the form of two so-called synchronisation gears which transmit the torque of the first rotor in whole to the second rotor with a fixed transmission ratio.

Such screw compressor is known for example from BE2015/5250.

The torque transfer transmission between both rotors is not only to transmit the torque but also to prevent the rotors from touching each other during rotation, which in the case of an oil-free screw compressor would otherwise lead to premature wear or damage due to the lack of oil lubrication.

The power required to displace the medium at a certain flow rate and at a certain pressure is thus supplied entirely by the single drive and transmitted entirely via the gear transmission to one of both rotors and via this rotor is partially transmitted to the second rotor.

A disadvantage is that the drive must have sufficient power to be able to provide this full power, which in the event of large powers may inevitably lead to choosing a large and bulky motor, for which there is not always sufficient space available at the user.

Additionally, the gear transmission between the single drive and one of the rotors and the rotor driven by the gear transmission must be designed to be able to cope with this supplied power and the related axial and radial forces and torques and furthermore the bearings in which the gearwheels of the gear transmission and of the transmission and the bearings in which the rotors are mounted with bearings must be calculated for this, which in its entirety can lead to relatively heavy, sizable and expensive solutions.

SUMMARY OF THE INVENTION

The invention is not limited to screw compressors or screw expanders, but applies to many other types of positive displacement periodic machines.

The purpose of the present invention is to provide a solution to one or more of the aforementioned and other disadvantages.

To this end, the invention relates to a positive displacement machine such as a compressor, expander, pump or the like, for displacing a gaseous or liquid medium, the machine containing an element with an inlet and an outlet for the medium and at least two cooperating driven moving parts, whereby the medium is displaced from the inlet to the outlet by the mutual periodic movement of the moving parts, characterised in that each of the at least two driven cooperating moving parts is provided with its own individual drive and that the element is provided with a kinematic synchronisation coupling between the at least two cooperating moving parts for the mutual kinematic synchronisation of their movements.

In this way, the power required to displace the medium with a given flow rate at a given pressure with the positive displacement machine is supplied by two separate individual drives, each with a smaller power than the total power required.

Due to the smaller power, smaller drives with a considerably smaller mass can be chosen, which can also be driven at higher speeds in a favourable manner.

As, according to the invention, the required power does not entirely need to be transmitted via the gear transmission and one of the at least two drives, according to the invention these components can also be made lighter than in the case of a single drive, and the bearings of these components will also be subjected to less big forces and thus have to meet lower requirements, which in turn can lead to cheaper bearings and thus to a lower cost of the positive displacement machine.

By lowering the masses of the moving parts, said parts can be driven at a higher speed such that the gear transmission can be reduced or preferably even completely left out by directly coupling the individual drives to the cooperating moving parts.

In this way, savings are realised in terms of the gear transmission and of the bearings of this transmission, resulting in fewer losses and thus a better efficiency of the positive displacement machine and a more compact and cheaper machine.

The kinematic synchronisation coupling between the moving parts must ensure that the moving parts never collide with each other, even if the individual drives drive unevenly, and in other words keeps the moving parts apart in a mechanically forced manner.

Also when the drive of the moving parts by the individual drives is not fully synchronised due to the inevitable imperfections in the drive and its synchronisation control, the kinematic synchronisation coupling will still ensure an imposed forced synchronisation.

Optimally balanced synchronous driving by means of the individual drives allows the kinematic synchronous coupling between the cooperating moving parts not to be loaded, or only to a very limited extent, as then they only need to accommodate the difference between the individual powers supplied by the individual drives to the moving parts.

This means the kinematic synchronisation coupling and its bearings, if any, can be designed lighter and in other words cheaper and smaller than the kinematic coupling of the known positive displacement machines with one single drive.

Preferably, the positive displacement machine according to the invention is also provided with a synchronisation controller to mutually synchronise the individual drives, i.e. to ensure that the individual drives are controlled in such a way that the cooperating moving parts do not come into contact with each other, at least theoretically cannot come into contact with each other.

However, in practice it has not yet been possible to develop a perfectly marketable controller that can react sufficiently quickly and accurately in all circumstances to ensure that the cooperating moving parts would not collide with each other if there was no synchronisation coupling present.

However, the kinematic synchronisation coupling does ensure that the errors of the synchronisation controller are compensated.

The synchronisation controller is a soft controller as it were, particularly a software-based controller, whereas the kinematic synchronisation coupling is a hard controller.

The invention particularly applies to positive displacement machines, the cooperating moving parts of the element of which are rotative parts and/or the individual drives are rotative drives, as in the case of a screw compressor or a screw expander with an element with two helical cooperating driven rotors which partly engage with their screws to compress or expand gas between the screws by their mutual movement.

In that case it is preferable according to the invention that the cooperating rotative parts are provided with a shaft and the individual rotative drives are provided with an output drive shaft with which they are directly coupled to the shaft of a relevant driven part.

In this way, savings are realised in terms of a transmission between the individual drives and the cooperating moving parts. The advantages of this are fewer moving parts, smaller size and less heavy.

Rotative is also understood to mean oscillating rotative or orbiting rotative as in the case of a spiral compressor, for example.

According to a simple realisation, the kinematic synchronisation coupling contains a gear transmission between the at least two cooperating moving parts of the element.

According to a preferred embodiment, the positive displacement machine is an oil-free screw compressor or an oil-free screw expander or tooth compressor. In this type of positive displacement machines, the synchronisation between the cooperating rotating parts is extremely important, as they may not make any contact due to the lack of a lubricating oil film and the very tight play between the engaging rotors which is necessary to minimise the leaks of the compressed medium between the rotors as much as possible.

According to a practical realisation of the invention the individual drives are, more particularly, rotative drives with a variable adjustable speed and the synchronisation controller contains a primary control algorithm for controlling the speed of one of the at least two individual rotative drives, referred to as the master drive here, as a function of a set primary control criterion, for example for controlling a desired pressure or a desired flow rate of the medium displaced by the machine.

Preferably the synchronisation controller contains a secondary control algorithm for controlling the speed of the other of the at least two individual rotative drives, referred to as the slave drive here, and this in such a way that the speeds of the master drive and the slave drive are mutually synchronised, e.g. in such a way that the ratio between the speed of the master drive and the speed of the slave drive is practically constant, preferably with a maximum deviation of less than 5%, even more preferably less than 2% and most preferably less than 1%.

The invention also relates to a method for displacing a liquid or gaseous medium by means of a positive displacement machine with an element with at least two cooperating driven moving parts which by their mutual periodic movement can displace the medium, whereby the method comprises the following steps:

- individually driving the at least two cooperating driven moving parts by means of an individual drive for each of the at least two cooperating driven parts;
- providing a kinematic synchronisation coupling between the at least two cooperating driven moving parts to prevent that said moving parts were to interfere with each other.

Preferably the method also applies the step of synchronously driving the individual drives and preferably comprises the following steps:

- determining the frequencies of the movements of each of the at least two individual drives;
- the primary control of the frequency of the movements of one of the at least two individual drives, i.e. the master drive, as a function of a set primary control criterion; and,
- the secondary control of the frequency of the movements of the other of the at least two individual drives, i.e. the slave drive, to keep the ratio between these frequencies practically constant.

BRIEF DESCRIPTION OF THE DRAWINGS

With the intention of better showing the characteristics of the invention, hereafter, by way of an example without any limiting nature, a preferred embodiment is described of a positive displacement periodic machine according to the invention and of a method thereby applied for displacing a liquid or gaseous medium, with reference to the accompanying drawings, wherein.

DETAILED DESCRIPTION OF THE INVENTION

Figure 1:
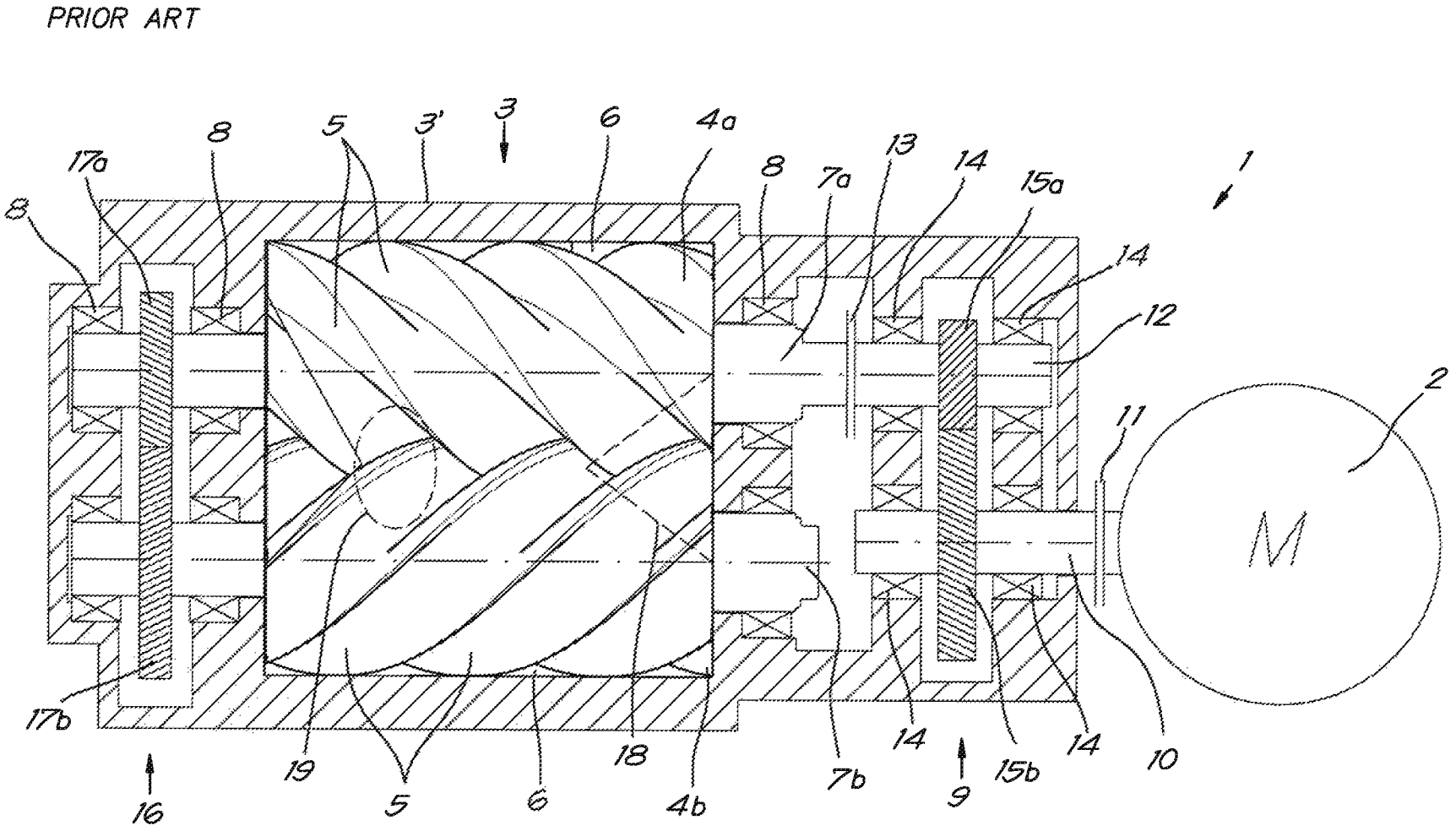
PRIOR ART Fig. 1
FIG. 1 schematically shows a known positive displacement machine.

In this case, by way of an example, the known positive displacement machine 1 shown in FIG. 1 is an oil-free screw compressor 1.

In this case the machine 1 contains one single and sole drive 1 in the form of an electric motor 2 and an element 3 with two cooperating moving parts 4, respectively a first and a second moving part 4*a* and 4*b*, in the form of two helical rotors which partially engage with their screws 5 and which have been rotatably mounted in a housing 3' of the element 3 with therein two overlapping cylindrical compression chambers 6 in which the cooperating moving parts 4 have been mounted closely fitting.

The cooperating moving parts 4 are provided with a shaft 7, respectively 7*a* and 7*b*, which are mounted on bearings by means of radial and axial bearings 8 in the housing 3' to secure the moving parts 4 in this case axially and radially.

The machine 1 contains a torque transfer transmission 9 with an input shaft 10 which is coupled directly or by means of a coupling 11 to the aforementioned single drive 2 and an output shaft 12 which may or may not be connected by means of a coupling 13 to the shaft 7*a* of the first moving part 4*a*.

The input shaft 10 and the output shaft 12 are mounted in the housing 5 by means of extra bearings 14.

In this case the transmission is a gear transmission with two engaging gearwheels 15, respectively a floating gearwheel 15*b* on the input shaft 10 and a driven gearwheel 15*a* on the output shaft 12, which is connected to the first moving part 4*a*.

In operation, the machine 1 is driven by means of the drive 2 which drives the first moving part 4*a* via the transmission 9.

The second moving part 4*b* is driven via a second torque transfer transmission 16 by the shaft 7*a* of the first moving part 4*a*, for which purpose a floating gearwheel 17*a* is mounted on the shaft 7*a* which engages with a driven gearwheel 17*b* on shaft 7*b* of the second moving part 4*b*.

Thanks to the drive both moving parts 4*a* and 4*b* are synchronously driven, for example at the same speed with the same number of revolutions, such that a gaseous medium is sucked in via an inlet 18 in the housing 3 and compressed between the screws 5 and is displaced to an outlet 19 in the housing to be supplied at a higher pressure to a pneumatic consumer.

The power required to supply the gaseous medium at a given pressure to the outlet 19 and a given flow rate to the consumer passes entirely over the transmission 9 and a significant part of this power passes over the transmission 16 and the moving parts that must be designed to cope with it. The bearings also have to be able to cope with it.

Figure 2:
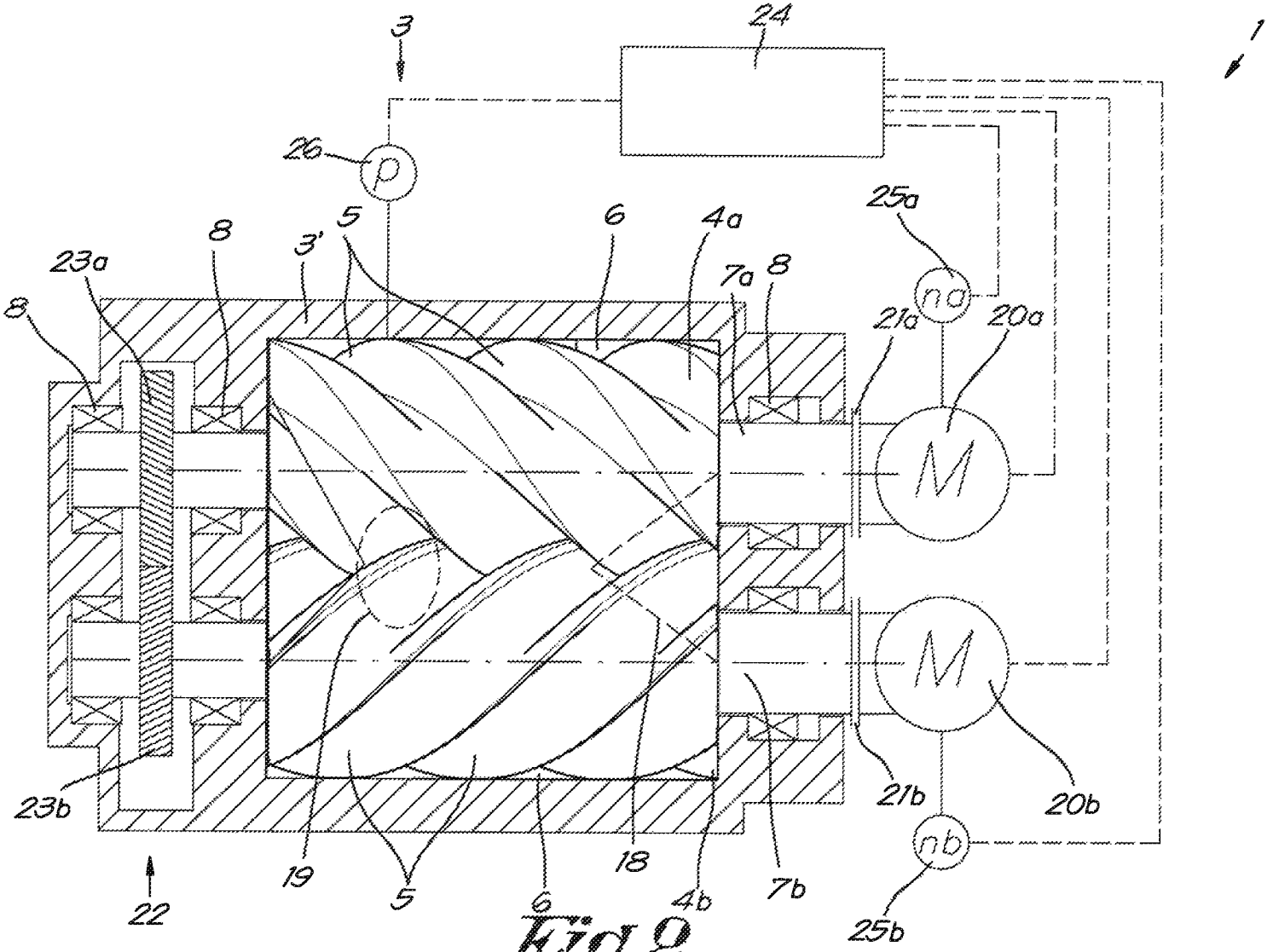
FIG. 2 schematically shows a positive displacement machine according to the invention with comparable capacity as that of the known machine of FIG. 1.

FIG. 2 shows a positive displacement machine of a comparable power to displace the medium at a certain pressure to the outlet 19 and flow rate, whereby the moving parts 4*a* and 4*b* in this case have the same dimensions as those of FIG. 1.

Specific to the invention is that, in this case, each of the two cooperating moving parts are provided with their own individual drive 20, 20*a* and 20*b* respectively, each of which in this case is directly coupled by means of a coupling 21, 21*a* and 21*b* respectively, to a respective shaft 7*a* and 7*b* of the cooperating moving parts 4*a* and 4*b* and that the element 3 is provided with a kinematic synchronisation coupling 22 between the at least two cooperating moving parts 4*a* and 4*b* for the mutual kinematic synchronisation of their movements.

The couplings 21*a* and 21*b* do not necessarily have to be separate couplings, but can also be a direct mechanical connection whereby the shafts of the drives 20*a* and 20*b* are one with the shafts 7*a* and 7*b*.

The shafts 7*a* and 7*b* are mounted in the housing 3' by means of bearings 8.

In the example the synchronisation coupling 22 is formed by two engaging gearwheels 23, a gearwheel 23*a* on the shaft 7*a* of the first moving part 4*a* and a gearwheel 23*b* on the shaft 7*b* of the second moving part 4*b* respectively.

The synchronisation coupling 22 has a fixed transmission ratio between the gearwheels 23*a* and 23*b*.

In this case the drives 20*a* and 20*b* are located at one axial end of the element 3, while the synchronisation coupling 22 is located at the other axial end of the element 3. However, it is not excluded that both drives 20*a* and 20*b* are located on the same axial end of the element 3 as the synchronisation coupling 22 or that one drive 20*a* is located at the same axial end as the synchronisation coupling 22 and the other drive 20*b* is located at the other end.

Analogue to FIG. 1, the element 3 is provided with an inlet 18 and an outlet 19.

The drives 20*a* and 20*b* are drives with a variable adjustable speed n and the positive displacement machine is provided with a synchronisation controller 24 which is connected to the drives 20*a* and 20*b* for the synchronous control of the speeds $n_a$ and $n_b$ of the cooperating moving parts 4*a* and 4*b* with a fixed ratio between the speeds $n_a$ and $n_b$, at least apart from the possible errors of the controller.

To this end, the element 3 is provided with means 25, respectively 25*a* and 25*b*, to determine the speed $n_a$ and $n_b$ of the individual drives 20*a* and 20*b*, said means 25 being connected with the aforementioned synchronisation controller 24 for the feedback of the speeds.

Furthermore, the positive displacement machine 1 is provided with means 26 to determine the pressure p at the outlet 19 of the element 3 and/or the flow rate of the displaced medium.

Preferably the synchronisation controller 24 contains a primary control algorithm for controlling, for example, the speed $n_a$ of one of the individual drives 20*a*, referred to as the master drive here, and this as a function of a set primary control criterion which is, for example, a desired pressure p or a desired flow rate as is already traditionally applied in positive displacement machines.

A secondary control algorithm of the synchronisation controller will then control the speed $n_b$ of the other individual drive 20*b*, referred to as the slave drive here, and this in such a way that the speeds $n_a$ and $n_b$ of the master drive and of the slave drive are mutually synchronised.

The secondary control algorithm is for example such that the ratio $n_a/n_b$ between the speed $n_a$ of the master drive 20*a* and the speed $n_b$ of the slave drive 20*b* is practically constant and equal or practically equal to a set value $(n_a/n_b)$ which is equal to the fixed transmission ratio of the kinematic synchronisation coupling 22, with a maximum deviation which is preferably less than 5%, more preferably less than 2% and most preferably less than 1%.

The method for using the positive displacement machine 1 according to the invention is simple and as follows.

The speed of the individual drive is controlled by the primary control algorithm such that a set pressure p at the outlet of 19 of the element 3 or a set flow rate is maintained.

Further, the secondary control algorithm ensures the second individual drive 20*b* is driven synchronously with the first individual drive 20*a*, i.e. making sure that the ratio between the speeds $n_a$ and $n_b$ always remains equal to the set value $(n_a/n_b)$ set which is equal to the transmission ratio of the kinematic synchronisation coupling 22. In other words, the speed $n_b$ of the slave drive 20*b* follows the variations of the speed $n_a$ of the master drive 20*a*.

With a theoretically perfect controller 24, no torque and therefore no power will be transmitted through the synchronisation coupling 22.

However, in case of a deviation of the synchronisation controller 24, the speed $n_b$ for example will lag slightly behind the speed $n_a$ with a certain deviation in relation to the set speed ratio $(n_a/n_b)$ set.

Without the kinematic synchronisation coupling 22 this would mean that the cooperating moving parts 4*a* and 4*b* would interfere against each other, which must be absolutely avoided.

However, the presence of the kinematic synchronisation coupling 22 avoids this forcefully and the moving part 4*a* with the greatest speed will help drive the moving part 4*b* with a lower speed via the kinematic synchronisation coupling 22 which will then have to absorb the power difference which is, however, limited and all the more limited such that the control of the speed by the synchronisation controller is more accurate.

It is clear that thanks to this the kinematic synchronisation coupling 22 can be made relatively light.

It is also clear that by applying the invention the relatively robust torque transfer transmissions 9 of the known positive displacement machine of FIG. 1 can be left out and/or the transmissions 9 and 16 of FIG. 1 can in any case be made much lighter.

For the primary control other criteria can be applied than a set pressure or flow rate such as a power control or the like.

The secondary control can also be based on other control criteria such as minimising the power transmitted via the kinematic synchronisation coupling 22.

It is also clear that the positive displacement machine does not necessarily have to be a rotative machine but also applies to, for example, machines with periodically linear moving parts between which a gaseous or liquid medium is displaced and which are each provided with their own individual drive and the frequency of the drives of which needs to be synchronised to avoid collisions.

The present invention is by no means limited to the embodiment described as an example and shown in the drawing, but a positive displacement periodic machine according to the invention and a method applied thereby for displacing a liquid or gaseous medium can be realised in all kinds of ways and forms without departing from the scope of the invention.

The invention claimed is:

1. A positive displacement machine for displacing a gaseous or liquid medium, the machine comprising:

an element with at least one inlet;

at least one outlet for the medium; and at least two cooperating driven moving parts, wherein a mutual periodic movement of the moving parts displaces the medium from the inlet to the outlet, wherein each of the at least two cooperating driven moving parts is provided with its own individual drive, and wherein the element is provided with a kinematic synchronisation coupling between the at least two cooperating driven moving parts for a mutual kinematic synchronisation of their movement, wherein the machine is provided with a synchronisation controller to mutually synchronise the individual drives, wherein the synchronisation controller contains a primary control algorithm for controlling the speed of one of the at least two individual rotative drives, referred to as a master drive, as a function of a set primary control criterion, wherein the synchronisation controller contains a secondary control algorithm for controlling the speed of the other of the at least two individual rotative drives, referred to as the slave drive, in such a way that the speeds of the master drive and of the slave drive are mutually synchronised, and wherein the secondary control algorithm is such that the ratio between the speed of the master drive $n_a$ and the speed of the slave drive $n_b$ is practically constant at a set value $(n_a/n_b)$set.

2. The positive displacement machine according to claim 1, wherein the cooperating moving parts of the element are rotative parts.

3. The positive displacement machine according to claim 1, wherein the individual drives are rotative drives.

4. The positive displacement machine according to claim 2, wherein the cooperating rotative parts are each provided with a shaft and the individual drives are each provided with a drive shaft directly connected to the shaft of a respective one of the cooperating rotative parts.

5. The positive displacement machine according to claim 1, wherein the kinematic synchronisation coupling contains a gear transmission with a fixed transmission ratio between the at least two cooperating moving parts of the element.

6. The positive displacement machine according to claim 1, wherein the machine is a screw compressor or tooth compressor or a screw expander with an element with two helical or tooth shaped cooperating driven rotors with screws or teeth which partly engage to compress or expand a gaseous medium between the screws by their mutual movement.

7. The positive displacement machine according to claim 1, wherein the machine is an oil-free screw compressor or an oil-free screw expander.

8. The positive displacement machine according to claim 1, wherein the individual drives are rotative drives with a variable adjustable speed and the machine is provided with means to determine the speed of the individual drives, said means being connected with said synchronisation controller for a feedback of the speeds.

9. The positive displacement machine according to claim 1, wherein the machine is provided with means to determine the pressure and/or the flow rate of the displaced medium and the primary control criterion is a desired pressure or a desired flow rate.

10. The positive displacement machine according to claim 1, wherein a ratio between the speed of the master drive and the speed of the slave drive is practically constant at the set value $(n_a/n_b)_{set}$ with a maximum deviation which is less than 5%.

11. The positive displacement machine according to claim 10, wherein the ratio between the speed of the master drive and the speed of the slave drive is practically constant at the set value $(n_a/n_b)_{set}$ with the maximum deviation which is less than 2%.

12. The positive displacement machine according to claim 11, wherein the ratio between the speed of the master drive and the speed of the slave drive is practically constant at the set value $(n_a/n_b)_{set}$ with the maximum deviation which is less than 1%.

13. The positive displacement machine according to claim 5, wherein the set value $(n_a/n_b)$ set of the ratio between the speed of the master drive and the speed of the slave drive is equal to the transmission ratio of the kinematic synchronisation coupling.

14. A method for displacing a liquid or gaseous medium by means of a positive displacement machine with an element with at least two cooperating driven moving parts which can displace the medium by their mutual periodic movement, the method comprising the following steps:

individually driving the at least two cooperating driven moving parts by means of an individual drive for each of the at least two cooperating driven moving parts; and providing a kinematic synchronisation coupling between the at least two cooperating driven moving parts to prevent that said moving parts interfere with each other;

synchronously driving the individual drives;

primarily controlling the speed $n_a$ of one of the at least two individual drives as a function of a set primary control criterion; and secondarily controlling the speed $n_b$ of the other of the at least two individual drives to keep a ratio $(n_a/n_b)$set between these speeds practically constant.

15. The method according to claim 14, further comprising the step of determining the pressure and/or the flow rate of the displaced medium, wherein the primary control criterion is a desired pressure or a desired flow rate.

* * * * *